US007591605B2

(12) United States Patent
Jonasz et al.

(10) Patent No.: US 7,591,605 B2
(45) Date of Patent: Sep. 22, 2009

(54) MODULAR TRAFFIC CALMING DEVICES

(75) Inventors: Slawomir Jonasz, Brossard (CA); Joseph Chait, Motréal (CA); Alain Masson, Hudson (CA)

(73) Assignee: GNR Technologies Inc., Lasalle, Quebec (CA)

( * ) Notice: Subject to any disclaimer, the term of this patent is extended or adjusted under 35 U.S.C. 154(b) by 0 days.

(21) Appl. No.: 11/380,717

(22) Filed: Apr. 28, 2006

(65) Prior Publication Data

US 2006/0245828 A1 Nov. 2, 2006

Related U.S. Application Data

(60) Provisional application No. 60/675,463, filed on Apr. 28, 2005.

(51) Int. Cl.
*E01F 9/047* (2006.01)

(52) U.S. Cl. ..... 404/15; 404/35; 404/41

(58) Field of Classification Search ..... 404/12, 404/13, 15, 35, 37, 38, 39, 40, 41
See application file for complete search history.

(56) References Cited

U.S. PATENT DOCUMENTS

| | | | | | |
|---|---|---|---|---|---|
| 1,581,345 | A | * | 4/1926 | Healy | 404/32 |
| 1,678,215 | A | * | 7/1928 | Greene | 404/13 |
| 2,826,393 | A | * | 3/1958 | Miller | 256/19 |
| 3,221,614 | A | * | 12/1965 | Pertien | 404/41 |
| 3,377,931 | A | * | 4/1968 | Hilton | 404/35 |
| 3,679,531 | A | * | 7/1972 | Weinand et al. | 428/33 |
| 3,859,000 | A | | 1/1975 | Webster | |
| 4,468,910 | A | | 9/1984 | Morrison | |
| 4,478,901 | A | * | 10/1984 | Dickens et al. | 428/120 |
| 4,494,892 | A | * | 1/1985 | Wojciechowski | 404/6 |
| 4,632,598 | A | * | 12/1986 | Richards | 404/6 |
| 4,690,583 | A | * | 9/1987 | Faulconer | 404/6 |
| 4,697,294 | A | | 10/1987 | Schäfer | |
| 4,727,697 | A | * | 3/1988 | Vaux | 52/177 |
| 5,098,218 | A | * | 3/1992 | Reese et al. | 404/35 |
| 5,106,226 | A | | 4/1992 | Fanslow et al. | |
| D336,524 | S | | 6/1993 | White et al. | |
| 5,242,242 | A | * | 9/1993 | Young | 404/12 |
| 5,341,533 | A | | 8/1994 | Seitz | |
| 5,403,637 | A | | 4/1995 | Pickard et al. | |
| 5,446,937 | A | | 9/1995 | Haskins | |
| 5,640,821 | A | | 6/1997 | Koch | |
| 5,769,563 | A | | 6/1998 | Flynn | |
| 5,777,266 | A | | 7/1998 | Herman et al. | |
| 5,833,386 | A | | 11/1998 | Rosan et al. | |
| 5,865,004 | A | | 2/1999 | Mitchell | |
| D412,490 | S | | 8/1999 | Henry | |
| D415,112 | S | | 10/1999 | Henry | |

(Continued)

FOREIGN PATENT DOCUMENTS

EP 0187294 A2 * 12/1985

(Continued)

*Primary Examiner*—Gary S Hartmann
(74) *Attorney, Agent, or Firm*—Ogilvy Renault LLP

(57) ABSTRACT

The modular traffic calming device comprises a plurality of substantially rectangular modules. Each module is connectable to one or more adjacent modules using a complementary interlocking connection across a first of the side faces of modules, and using a complementary non-interlocking connection across a second of the side faces of the modules.

25 Claims, 4 Drawing Sheets

U.S. PATENT DOCUMENTS

| | | | | |
|---|---|---|---|---|
| D418,818 | S | 1/2000 | Henry | |
| D425,627 | S | 5/2000 | Harwood et al. | |
| 6,174,103 | B1 * | 1/2001 | Stroman | 404/15 |
| 6,202,565 | B1 | 3/2001 | Henry | |
| 6,309,137 | B1 | 10/2001 | Hirsch | |
| 6,499,410 | B1 | 12/2002 | Berardi | |
| 6,505,444 | B1 | 1/2003 | Johnson | |
| 6,623,206 | B1 * | 9/2003 | Blair et al. | 404/16 |
| 6,654,977 | B1 | 12/2003 | Chin | |
| 6,718,588 | B1 | 4/2004 | Frederiksen | |
| 6,718,714 | B1 | 4/2004 | Montgomery, Sr. | |
| 6,878,881 | B1 * | 4/2005 | Henry | 174/101 |
| 6,993,801 | B2 * | 2/2006 | Marko et al. | 14/69.5 |
| 7,145,079 | B1 * | 12/2006 | Henry | 174/101 |
| 2002/0178661 | A1 * | 12/2002 | Burke et al. | 52/177 |

FOREIGN PATENT DOCUMENTS

| | | | |
|---|---|---|---|
| FR | 2590602 | A1 | 5/1987 |
| GB | 2030197 | A * | 4/1980 |
| JP | 2005207203 | * | 8/2005 |

* cited by examiner

MODULAR TRAFFIC CALMING DEVICES

CROSS-REFERENCE TO PRIOR APPLICATION

The present application claims the benefits of U.S. provisional patent application No. 60/675,463 filed Apr. 28, 2005, the contents of which is hereby incorporated by reference.

FIELD OF THE INVENTION

The invention relates to traffic calming devices like speed humps, speed tables, speed cushions, traffic islands, raised crosswalks, chokers, raised intersections, chicanes etc., and more particularly, to a novel design of traffic calming devices including various modules connected together.

BACKGROUND

Traffic calming is presently achieved by building speed bumps, speed humps and other similar devices mainly from asphalt or concrete. These conventional devices cannot be easily installed or removed. Moreover, there are difficulties in achieving consistent and stable profile of these devices during their lifetime.

There is clearly a need for traffic calming devices capable of having a nice esthetic appearance, a consistent profile, and be easy to install and, if required, to remove.

SUMMARY OF THE INVENTION

It is proposed that the traffic calming devices be constructed using two or more prefabricated modules. Thus, installation and removal of such devices can be greatly facilitated upon using a plurality of relatively lightweight modules and a simple installation method.

Accordingly, there is provided a modular traffic calming device comprising at least two substantially rectangular modules, each module having an upper face, a ground-engaging face, at least one first side face and at least one second side face that is perpendicular to the at least one first side face, each module having a complementary interlocking connection with an adjacent one of the modules when their first side faces are adjoined, and a non-interlocking connection with an adjacent one of modules when their second side faces are adjoined.

There is also provided a modular traffic calming device, the device comprising at least two substantially rectangular modules interconnected side-by-side, each module comprising an upper face, a ground-engaging bottom face, at least one first side face extending in a first direction and at least one second side face extending in a second direction, each module having at least one first side face configured and disposed to be adjoined to the first side face of another of the modules of the device, each module further having at least one second side face configured and disposed to be adjoined to the second side face of another of the modules of the device, the first side faces being connectable together by complementary interlocking connectors and the second side faces being connectable together by complementary non-interlocking connectors.

There is further provided a module for a modular traffic calming device comprising a plurality of modules, the module comprising: an upper face; a ground-engaging bottom face; a first side face extending in a first direction; a second side face extending in a second direction that is perpendicular to the first direction; means for providing an interlocking connection between two adjacent modules when their first side faces are adjoined; and means for providing a non-interlocking connection between two adjacent modules when their second side faces are adjoined.

There is further provided a method of assembling a modular traffic calming device having a plurality of adjacently-disposed modules interconnected together, each module having an upper face, a ground-engaging bottom face, at least one first side face extending in a first direction and at least one second side face extending in a second direction, the method comprising, in no particular order: connecting the first side faces of at least one set of adjacently-disposed modules using a complementary interlocking connection; connecting the second side faces of at least one set of adjacently-disposed modules using a complementary non-interlocking connection.

There is further provided a modular traffic calming device comprising a plurality of substantially rectangular modules, each module having an upper face, a ground-engaging face, at least one first side face and at least one second side face that is perpendicular to the at least one first side face, each module being made in accordance with at least one standardized module shape, each module being connectable to an adjacent module using a complementary interlocking connection across their first side faces.

These and other aspects of the modular traffic calming device will be described in details in the following description of an example thereof, which description is made with reference to the appended figures.

DETAILED DESCRIPTION

Figure 1:
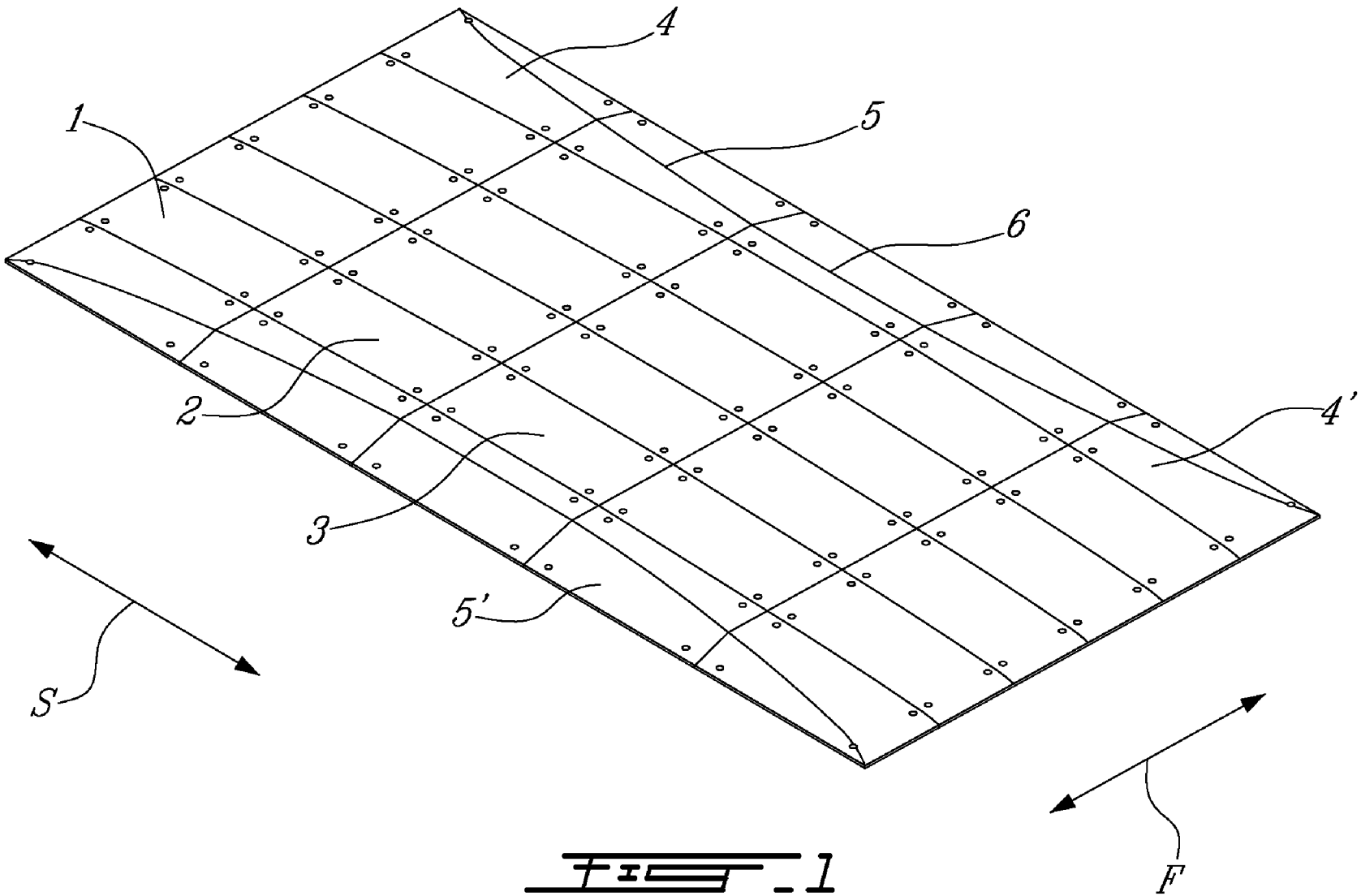
FIG. 1 is a perspective view of an example of a traffic calming device in the form of a speed hump that is built from various modules disclosed herein.
Figure 5:
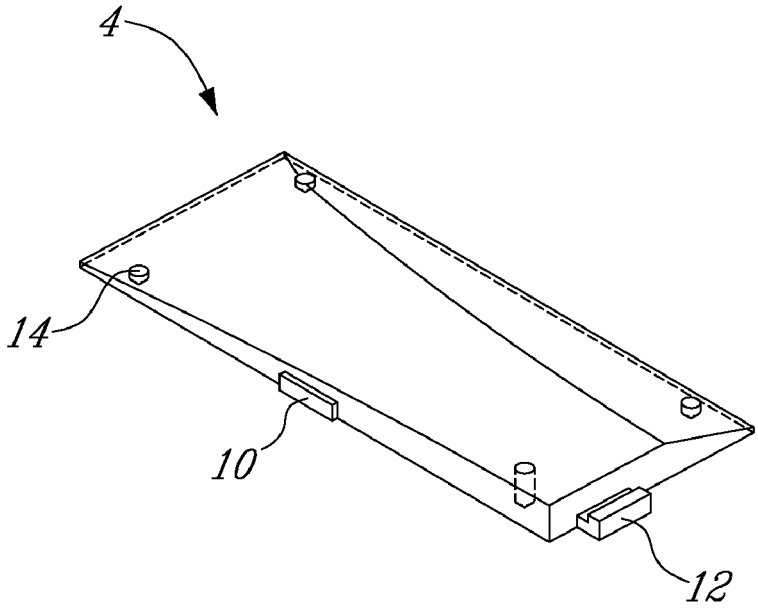
FIG. 5 is a perspective view of a corner module shown in FIG. 1.

FIG. 1 shows an example of one among many possible traffic calming devices like speed humps, speed tables, speed cushions, traffic islands, raised crosswalks, chokers, raised intersections, chicanes etc. that can be built using one or more standardized module shapes, as exemplified by modules 1 to 6. Complementary module shapes are also used in the device shown in FIG. 1, being understood that complementary modules 4' and 5' are substantially mirror equivalents of the modules 4 to 5 shown in FIGS. 5 and 6. The various traffic calming devices are built from two or more modules. Thus, a relatively small number of standardized module shapes are needed to make an almost unlimited variety of different traffic calming devices.

Figure 2:
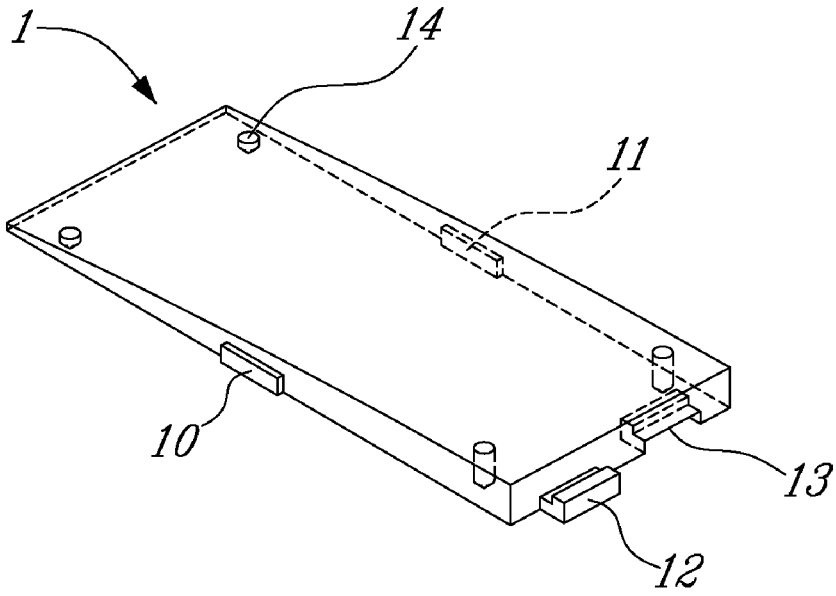
FIG. 2 is a perspective view of the middle, starting module shown in FIG. 1.
Figure 3:
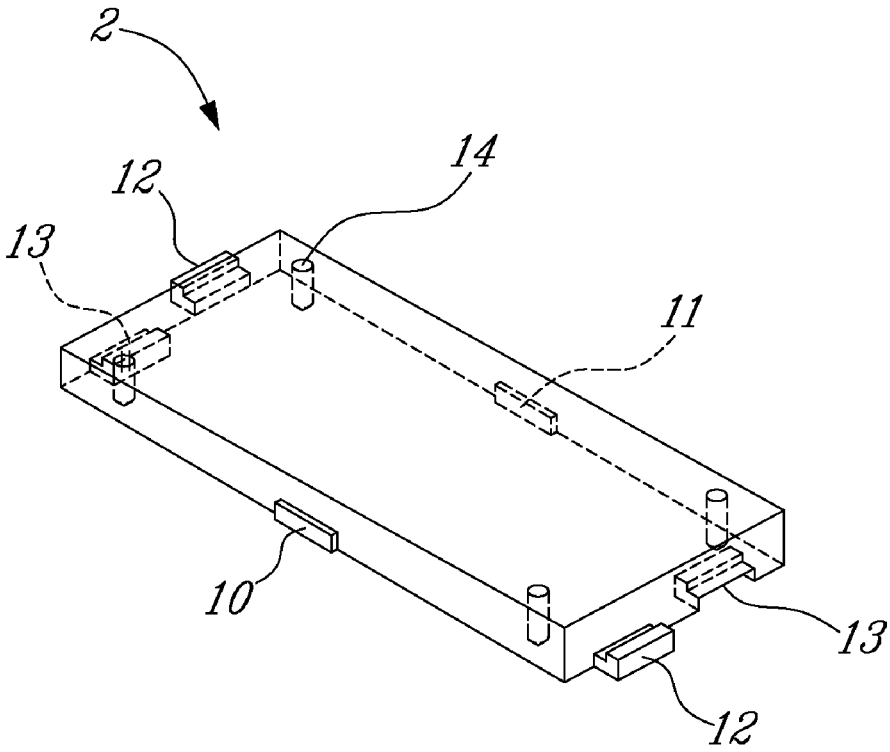
FIG. 3 is a perspective view of middle, inclined module shown in FIG. 1.
Figure 4:
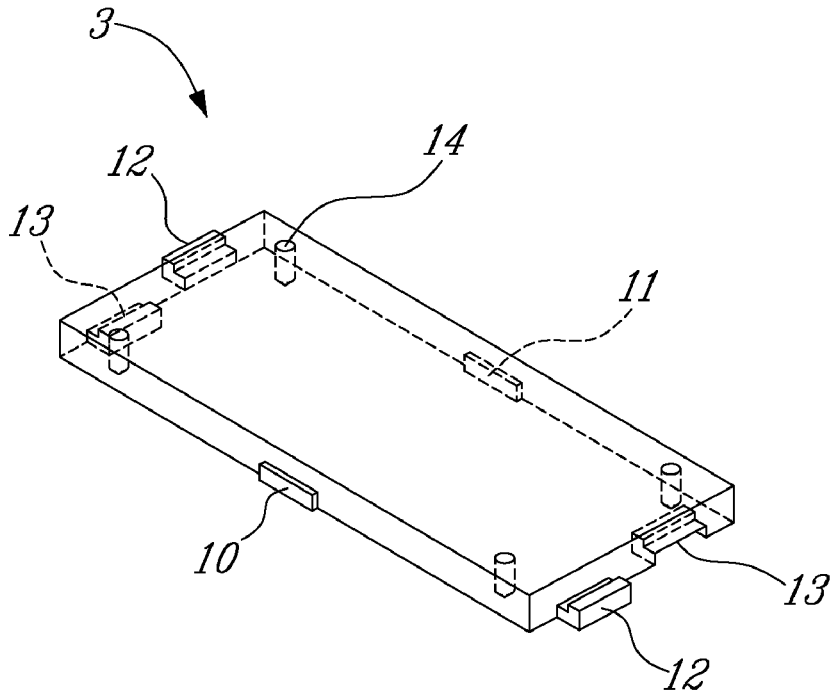
FIG. 4 is a perspective view of a middle, flat module shown in FIG. 1.

FIG. 2 shows middle, starting inclined module 1. One side of the module 1 is wedge shaped. FIG. 3 shows a middle, inclined module 2. FIG. 4 shows a middle, flat module 3. FIG.

Figure 6:
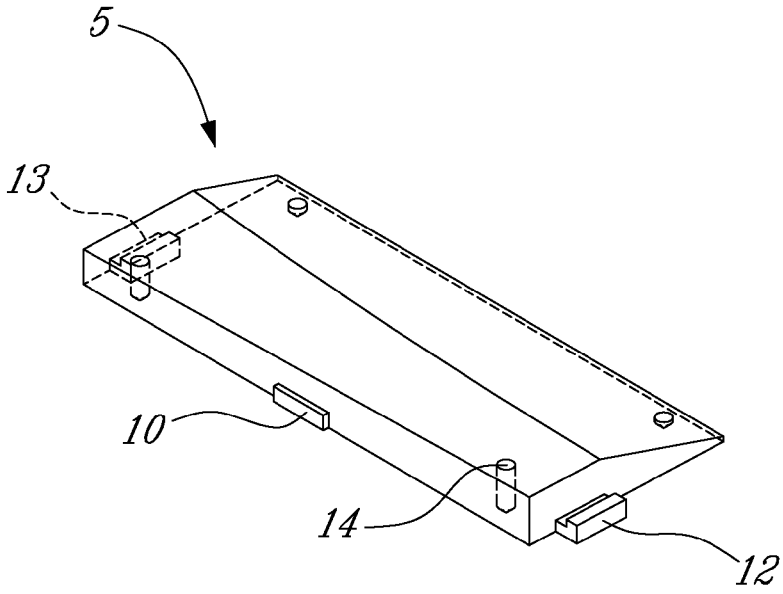
FIG. 6 is a perspective view of an end cap, inclined module shown in FIG. 1.
Figure 7:
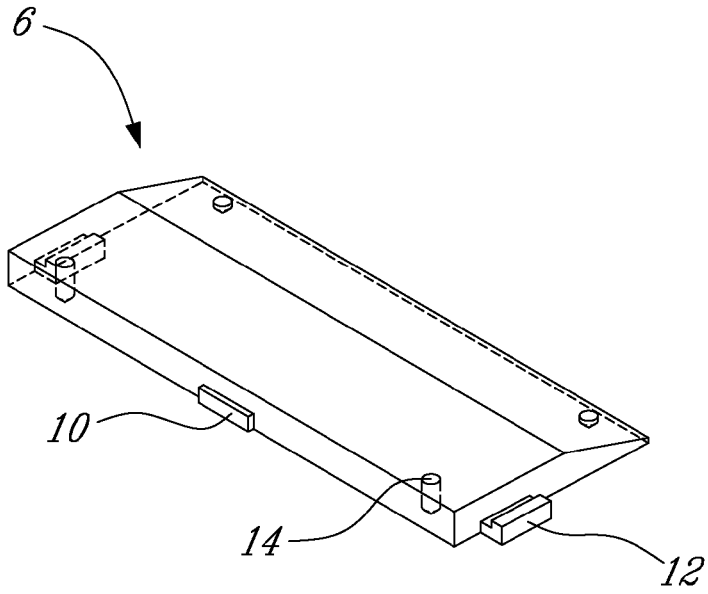
FIG. 7 is a perspective view of an end cap, flat module shown in FIG. 1.
Figure 8:
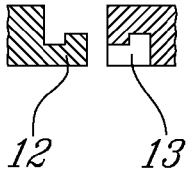
FIG. 8 is an enlarged cross-section view of an example of complementary interlocking connectors.

5 shows a corner module 4. FIG. 6 shows an end cap, inclined module 5. FIG. 7 shows an end cap, flat module 6.

As shown in FIG. 1, the modular traffic calming device comprises a plurality of substantially rectangular modules interconnected side-by-side, preferably forming a grid-like arrangement. Each module has an upper face, a ground-engaging face, at least one first side face and at least one second side face that is perpendicular to its first side face or faces. In the illustrated embodiment, the first side faces are extending parallel to the first direction that is identified with the arrow F while the second side faces are extending parallel to the second direction that is identified with the arrow S. Together, the upper faces of the modules, once connected together, form a continuous upper surface of the device.

When building a device, one can use two or three modules only, depending on the design. However, as illustrated, each module is connectable to at least one adjacent module using a complementary interlocking connection across their first side faces, when adjoined. Each module is also connectable to at least one adjacent module using a complementary non-interlocking connection across their second side faces, when adjoined.

In the present context, the expression "interlocking connection" means a connection that can somewhat hold together two adjacent modules when a force perpendicular to their first side faces is applied (i.e. forcing them to move away from each other). The expression "non-interlocking connection" means a connection which does not significantly hold the modules together with a force perpendicular to their second side faces is applied. However, the non-interlocking connection can prevent two adjacent modules to slide, relative to each other, along their second side faces. The combination of connectors provides a suitable way of connecting all modules of a device and spread the impact force of the passing vehicle on all modules, thus increasing stability and durability of the installation under impact.

In the illustrated example, each complementary non-interlocking connection includes at least one rectangular projection 10 in one module and a corresponding rectangular recess 11 in an adjacent module. These figures also show that each complementary interlocking connection includes at least one L-shaped flange 12 in one module and at least one corresponding L-shaped recess 13 in an adjacent module. There is preferably two spaced-apart L-shaped flanges and two corresponding L-shaped recesses in each connection, as shown. Furthermore, the L-shaped flanges 12 and recesses 13, as well as the rectangular projection 10 and corresponding recess 11, are configured and disposed so that the modules are reversible (i.e. rotated 180° around a vertical axis for use elsewhere in the device). As can be seen, for instance, the module 2 of FIG. 3 can fit at either ends of the module 3 shown in FIG. 4. Likewise, the design of the modules also allows them to be easily matched side-by-side. One side has the rectangular projection 10 and the opposite side has the corresponding rectangular recess 11. This way, the device can be assembled relatively easily by connecting the first side faces of adjacent modules and the second side faces of adjacent modules in no particular order. One of the resulting advantages is that the installation of the modules on a road can be performed without entirely closing the road for traffic. For instance, the modules can then be installed on one side or section of the road while the other side or section of the road could be opened for traffic. When a first portion of the traffic calming device is completed, this portion can be returned for traffic while the installation of the other portion of the device is made. Thus only one side of the road or street needs to be closed for traffic at a time.

The devices can be temporarily or permanently fixed to the ground, depending on the requirements. The modules can be anchored to the ground with vertical anchoring elements such as fixing screws or spikes, preferably using the lag bolts with shields. One or more mounting holes 14 are also provided between opposite upper and bottom surfaces of the modules to accommodate the anchoring elements. The upper side of these holes 14 can be chamfered to hide the head of the anchoring elements.

The ground-engaging faces of the modules can be flat or provided with various types of pockets, grooves or channels created in order to reduce the weight of the modules within the compression requirements for such product. Continuous channels through the bottom side of the whole device, preferably perpendicularly to the direction of the traffic, can also be created to accommodate cables or hoses to be passed across the device. Further, channels from front to back of the modules can be created to facilitate storm water drainage.

Various materials can be used to make the modules. Plastic, rubber, metal or combination thereof, and especially recycled plastic and rubber or mixture of both, are the most economical. Other materials can be used as well. The use of recycled rubber from used tires is particularly advantageous since the material is slightly flexible and resistant to wear.

The modules can be of the same color, for example black or any other color, but are preferably marked with various patterns created by a bright and distinct paint contrasting from the color of the modules, preferably traffic yellow or other color depending on local requirements. It is also possible to use tape or various inserts made of plastic material, rubber like material or another material having various shapes, such as square, circular, stripes, etc., on the top surface of the modules in order to increase visibility of the modules installed on a street or a road. One possibility is to provide at the surface a bright reflective material that is molded within the material of the modules. This way, the reflective material is more durable. Still, various kinds of finishes of the top surface of the modules can be utilized, preferably non-skid patterns created by a series of grooves and bumps. Security of the installation can be further increased by molding the modules with a steel plate, square or round, around the mounting holes 14, which plate would spread the load of the anchoring element on a wider surface.

Depending on the requirements, various modules can be created with different profile, thickness and lateral dimensions, especially with the possibility that each module be handled by one or few installers without need for heavy lifting equipment like forklifts or cranes. Ideally, each module should have a weight not exceeding 150 lbs for an easy handling by hand.

The above description is therefore meant to be exemplary only, and one skilled in the art will recognize that other changes may also be made to the embodiments described without departing from the scope of the invention disclosed as defined by the appended claims. For instance, the modules are limited to the exact shape of the ones shown in FIG. 1 to 8. Some modules, especially ones at the corner of the traffic calming devices, may have a shape that is more or less truncated. This is intended to be covered by the expression "substantially rectangular". Also, the modules may have different sizes and some, or even all, may be square shaped.

The "first direction" and "second direction", as illustrated, correspond to the transversal and longitudinal direction of the individual modules, respectively. It can also be the opposite. The first direction and the second direction are not necessarily lined to the traffic direction.

The complementary interlocking connectors are not limited to L-shaped flanges and recesses. Other kinds of complementary interlocking connectors can be used, including male and female connectors. Likewise, the complementary non-interlocking connectors are not limited to rectangular flanges and recesses. Pegs or elongated elements of almost any shape can be used as well. The use ground anchoring elements may be omitted in certain circumstances.

What is claimed is:

1. A modular vehicle traffic calming device comprising at least two substantially rectangular traffic calming modules, each module having an upper face, a ground-engaging face, at least one first side face and at least one second side face that is perpendicular to the at least one first side face, adjacent ones of the modules being removably interconnected through adjacent ones of the first side faces or through adjacent ones of the second side faces, the adjacent first side faces including complementary interlocking connectors forming a detachable connection resisting detachment when a first pulling force moving the adjacent first side faces away from each other is applied perpendicularly thereto, the adjacent second side faces including complementary non-interlocking connectors forming a detachable connection resisting detachment when a sliding force is applied along the adjacent second side faces and allowing detachment when a second pulling force moving the adjacent second side faces away from each other is applied perpendicularly thereto.

2. The device as claimed in claim 1, wherein the complementary non-interlocking connectors include at least one rectangular projection in one of the adjacent second side faces and a corresponding rectangular recess in the other of the adjacent second side faces.

3. The device as claimed in claim 1, wherein the complementary interlocking connectors include at least one L-shaped flange in one of the adjacent first side faces and a corresponding L-shaped recess in the other of the adjacent first side faces.

4. The device as claimed in claim 1, wherein the complementary interlocking connectors and the complementary non-interlocking connectors of the modules are configured and disposed so that the modules can be reversible.

5. The device as claimed in claim 1, wherein each module has a weight that is less than 150 lbs.

6. The device as claimed in claim 1, wherein each module is made of a material selected from a group consisting of plastic, rubber, metal and combinations thereof.

7. The device as claimed in claim 6, wherein at least one among the plastic and the rubber includes recycled material.

8. The device as claimed in claim 6, wherein at least some of the modules include a bright reflective material on their upper face, the reflective material being molded within the material of the modules.

9. The device as claimed in claim 1, wherein each module further comprises at least one mounting hole extending from its upper face to its ground-engaging face to receive a ground anchoring element.

10. A modular traffic calming device, the device comprising at least four substantially rectangular traffic calming modules interconnected side-by-side, each module comprising an upper face, a ground-engaging bottom face, at least one first side face extending in a first direction and at least one second side face extending in a second direction, each module having at least one first side face configured and disposed to be adjoined to the first side face of another of the modules of the device, each module further having at least one second side face configured and disposed to be adjoined to the second side face of another of the modules of the device, the first side faces being connectable together by complementary interlocking connectors forming a detachable connection resisting detachment when a pulling force perpendicular to the first side faces is applied thereto, and the second side faces being connectable together by complementary non-interlocking connectors forming a detachable connection allowing detachment when a pulling force perpendicular to the second side faces is applied thereto.

11. The device as claimed in claim 10, wherein the complementary non-interlocking connection includes at least one rectangular projection in one module and a corresponding rectangular recess in an adjacent module.

12. The device as claimed in claim 10, wherein the complementary interlocking connection includes at least one L-shaped flange in one module and a corresponding L-shaped recess in an adjacent module.

13. The device as claimed in claim 10, wherein the complementary interlocking connection and the complementary non-interlocking connection between the modules are configured and disposed so that the modules be reversible.

14. The device as claimed in claim 10, wherein each module has a weight that is less than 150 lbs.

15. The device as claimed in claim 10, wherein each module is made of a material selected from a group consisting of plastic, rubber, metal and combinations thereof.

16. The device as claimed in claim 15, wherein at least one among the plastic and the rubber includes recycled material.

17. The device as claimed in claim 15, wherein at least one of the modules includes a bright reflective material on its upper face, the reflective material being molded within the material.

18. The device as claimed in claim 10, wherein each module further comprises at least one mounting hole extending from its upper face to its ground-engaging face to receive a ground anchoring element.

19. A module for a modular vehicle traffic calming device comprising a plurality of modules, the module comprising:

an upper face;

a ground-engaging bottom face;

a first side face extending in a first direction;

a second side face extending in a second direction that is perpendicular to the first direction;

the first side face including a first connector for providing an interlocking connection between two adjacent modules when their first side faces are adjoined, the interlocking connection being detachable and resisting detachment when a first pulling force is applied perpendicularly to the first side faces; and the second side face including a second connector forming part of a non-interlocking connection between two adjacent modules when their second side faces are adjoined, the non-interlocking connection resisting detachment when a sliding force is applied along the adjacent second side faces and allowing detachment when a second pulling force is applied perpendicularly to the second side faces.

20. The module as claimed in claim 19, wherein the module has a weight that is less than 150 lbs.

21. The module as claimed in claim 19, wherein the module is made of a material selected from a group consisting of plastic, rubber, metal and combinations thereof.

22. The module as claimed in claim 21, wherein at least one among the plastic and the rubber includes recycled material.

23. The module as claimed in claim 21, further comprising a bright reflective material on its upper face, the reflective material being integrally molded with other parts of the module.

24. The module as claimed in claim 19, further comprising at least one mounting hole extending from its upper face to its ground-engaging face to receive a ground anchoring element.

25. A method of assembling a modular vehicle traffic calming device having a plurality of adjacently-disposed modules interconnected together, each module having an upper face to be engaged by passing vehicles, a ground-engaging bottom face, at least one first side face extending in a first direction and at least one second side face extending in a second direction, the method comprising, in no particular order:

connecting the first side faces of at least one set of adjacently-disposed modules using a detachable complementary interlocking connection, the interlocking connection resisting detachment when a first pulling force moving the adjacent first side faces away from each other is applied perpendicularly thereto;

connecting the second side faces of at least one set of adjacently-disposed modules using a detachable complementary non-interlocking connection, the non-interlocking connection resisting detachment when a sliding force is applied along the adjacent second side faces and allowing detachment when a second pulling force moving the adjacent second side faces away from each other is applied perpendicularly thereto.

* * * * *